US008963031B2

(12) United States Patent
Fujimoto et al.

(10) Patent No.: US 8,963,031 B2
(45) Date of Patent: Feb. 24, 2015

(54) SWITCH UNIT

(75) Inventors: Takeyoshi Fujimoto, Utsunomiya (JP); Yasuo Motohashi, New Delhi (IN); Koji Hashimoto, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 275 days.

(21) Appl. No.: 13/635,794

(22) PCT Filed: Feb. 7, 2011

(86) PCT No.: PCT/JP2011/052495

§ 371 (c)(1),
(2), (4) Date: Sep. 18, 2012

(87) PCT Pub. No.: WO2011/118268

PCT Pub. Date: Sep. 29, 2011

(65) Prior Publication Data

US 2013/0015047 A1 Jan. 17, 2013

(30) Foreign Application Priority Data

Mar. 24, 2010 (JP) ..... 2010-068131

(51) Int. Cl.

| | |
|---|---|
| ***H01H 9/04*** | (2006.01) |
| ***H01H 23/06*** | (2006.01) |
| *H01H 21/24* | (2006.01) |
| *H01H 21/22* | (2006.01) |
| *H01H 21/08* | (2006.01) |

(52) U.S. Cl.

CPC ..... *H01H 9/047* (2013.01); *H01H 23/06* (2013.01); *H01H 21/24* (2013.01); *H01H 2021/225* (2013.01); *H01H 2300/01* (2013.01); *H01H 2223/004* (2013.01); *H01H 21/08* (2013.01)

USPC ..... 200/302.1

(58) Field of Classification Search

USPC ..... 200/302.1–302.3; 439/206

See application file for complete search history.

(56) References Cited

U.S. PATENT DOCUMENTS

| | | | | |
|---|---|---|---|---|
| 4,268,734 | A * | 5/1981 | Sorenson | 200/302.3 |
| 5,876,243 | A * | 3/1999 | Sangawa | 439/519 |
| 7,294,801 | B2 * | 11/2007 | Shimizu | 200/302.3 |

FOREIGN PATENT DOCUMENTS

| | | |
|---|---|---|
| CN | 1151601 | 6/1997 |
| JP | 63-182022 | 11/1988 |

(Continued)

OTHER PUBLICATIONS

Japanese Office Action and English Translation, Application No. 2012-506874, Dated May 21, 2013, 4 pages.

(Continued)

*Primary Examiner* — Renee S Luebke
*Assistant Examiner* — Lheiren Mae A Caroc
(74) *Attorney, Agent, or Firm* — Rankin, Hill & Clark LLP

(57) ABSTRACT

A switch unit includes an upper case that has an operation portion attached therein; a circuit board that has a switch attached thereto that is able to switch contact points by operation of the operation portion; and a lower case that fits into the upper case such that the lower case is surrounded by the upper case, and that accommodates the circuit board between the upper case and the lower case. A draining portion is provided at a side surface of the upper case, and the draining portion is integrally formed with a sidewall forming the side surface and protrudes downward, and has a width that gradually narrows from the top to the bottom thereof.

7 Claims, 6 Drawing Sheets

(56) References Cited

FOREIGN PATENT DOCUMENTS

| | | |
|---|---|---|
| JP | 3001135 | 6/1994 |
| JP | 9-204842 | 8/1997 |
| JP | 9-265851 | 10/1997 |
| JP | 2007-249456 | 9/2007 |

OTHER PUBLICATIONS

Chinese Office Action for Application No. 201180014661.4 dated Jun. 12, 2014; partial English translation included.

* cited by examiner

SWITCH UNIT

TECHNICAL FIELD

The present invention relates to a switch unit into which water hardly permeates.

Priority is claimed on Japanese Patent Application No. 2010-068131, filed Mar. 24, 2010, the content of which is incorporated herein by reference.

BACKGROUND ART

A switch unit in which a printed-circuit board and the like are accommodated employs a structure into which water hardly permeates since it is necessary to prevent water from permeating into the switch unit.

For example, a switch unit disclosed in Patent Document 1 has a structure that includes a lower case and an upper case fitted to the lower case from above. A printed-circuit board and the like are accommodated in the lower case, and operation portions of switches are provided at an upper portion of the upper case. Protruding portions formed on the side surfaces of the lower case are engaged with engaging holes formed at the side surfaces of the upper case, so that the upper case and the lower case are integrated with each other. Here, in order to prevent water from permeating from the engaging holes of the upper case, ribs are formed on the side surfaces of the upper case so as to surround upper portions and side portions of the engaging holes and guide water droplets and the like, which trickle down the side surfaces of the upper case from above, so that the water droplets flow down along the outsides of the ribs and the like.

CITATION LIST

Patent Document

Patent Document 1: Japanese Unexamined Patent Application, First Publication No. 9-265851

SUMMARY OF INVENTION

Technical Problem

However, in the switch unit having the above-mentioned structure, water flows over the ribs and flows to the inside of the ribs when a large amount of water falls on the upper case. Accordingly, there is a concern that water permeates from the locking holes. If the height of the rib is increased to prevent this, a fitting portion between the lower and upper cases becomes bulky. For this reason, there is a problem in that the size of the switch unit is increased.

Accordingly, the invention provides a switch unit into which water hardly permeates.

Solution to Problem

In a switch unit according to the invention, the following means is employed to solve the above-mentioned problem.

A switch unit includes an upper case on which operation portions are mounted, a circuit board on which switches of which contact points are switched through the operation of the operation portions are mounted, and a lower case that is fitted to the upper case so that side surfaces of the lower case are surrounded by the upper case. The circuit board is accommodated between the upper case and the lower case. Draining portions, which are formed integrally with side walls forming side surfaces of the upper case so as to protrude downward and of which the width is gradually reduced toward the lower side from the upper side, are formed at the side surfaces of the upper case.

According to the invention, water having trickled down the side surfaces of the upper case is guided to the draining portions and flows down so that the width is gradually reduced in accordance with the shape of the draining portion. Accordingly, it is possible to control a drain position. Further, even when a large amount of water falls, it is possible to guide the large amount of water by making the large amount of water trickle down.

The switch unit may further include a connector that is provided on a bottom portion of the lower case and includes terminals electrically connected to the switches. The connector may include an opening portion that allows a plug electrically connected to the connector to be electrically connected to the terminals in a direction parallel to a longitudinal direction of the lower case as an insertion/separation direction. The draining portions may be disposed behind a position which overlaps the opening portion of the connector in the longitudinal direction of the lower case, in an insertion direction of the plug.

In this case, it is possible to reduce the probability that water permeates into the connector from the opening portion of the connector.

The draining portion may include two inclined sides that are inclined with respect to a horizontal direction at substantially the same angle and are disposed on the near side in the insertion direction of the plug and on the far side in the insertion direction of the plug, and the inclined side, which is disposed on the near side in the insertion direction of the plug, may be longer than the inclined side that is disposed on the far side in the insertion direction of the plug.

In this case, the long inclined side of the flow passage for water, which is disposed on the near side, can guide water over a long distance as compared to the short inclined side of the flow passage for water that is disposed on the far side. Accordingly, even when the switch unit is in an inclined attitude where the rear portion of the switch unit in the longitudinal direction is lowered, it is possible to reduce the probability that water adheres near the opening portion of the connector.

Engaging claws, which are engaged with the lower case, may be formed on the insides of the side surfaces of the upper case; engagement accommodating portions, which are engaged with the engaging claws of the upper case, may be formed at a bottom of the lower case; and the bottom of the lower case may be fitted into the upper case and the engaging claws are locked to the engagement accommodating portions.

In this case, since it is not necessary to form holes and the like that are used to lock the lower case to the upper case, it is possible to further reduce the probability that water permeates into the upper and lower cases.

Advantageous Effects of Invention

According to the invention, water having trickled down the side surfaces of the upper case is guided to the draining portions and flows down so that the width is gradually reduced in accordance with the shape of the draining portion. Accordingly, it becomes possible to control a drain position. Further, even when a large amount of water falls, it is possible to guide the large amount of water by making the large amount of water trickle down.

DESCRIPTION OF EMBODIMENTS

Figure 1:
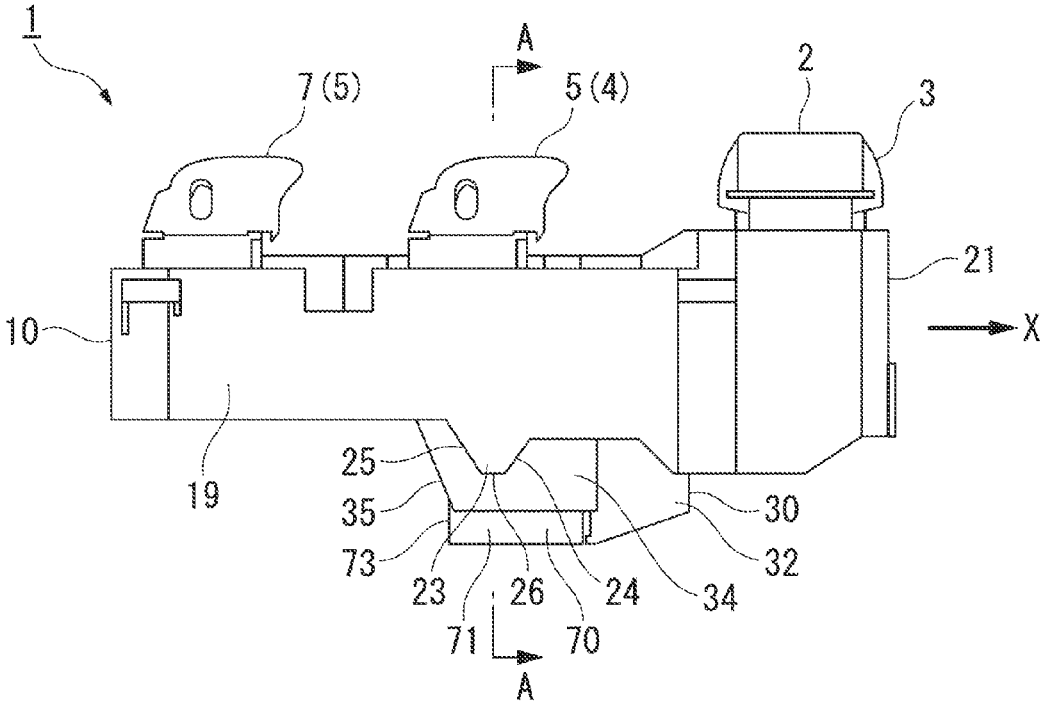
FIG. 1 is a front view of a switch unit according to an embodiment of the invention.
Figure 2:
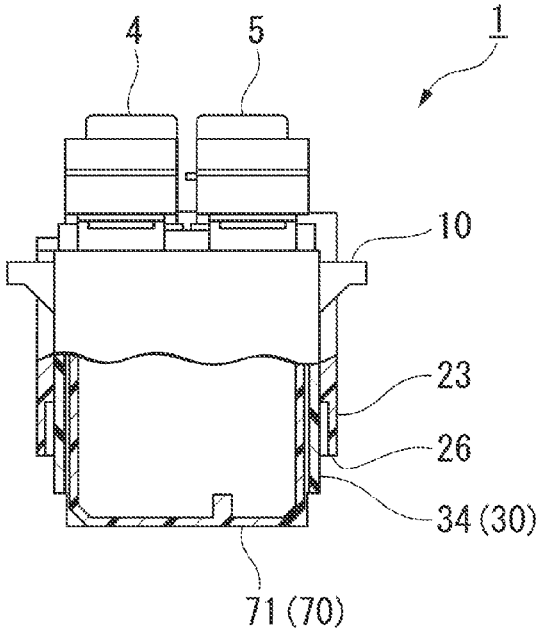
FIG. 2 is a cross-sectional view taken along line A-A of FIG. 1.

A switch unit according to an embodiment of the invention will be described below with reference to FIGS. 1 to 9.

The switch unit according to this embodiment is a power window switch that is used to automatically open and close glass windows of a left hand drive car. This switch unit is provided on an armrest of a door of an automobile that corresponds to a driver's seat. Meanwhile, an arrow X indicates the front side of a vehicle in the respective drawings.

As shown in FIGS. 1 to 4, a switch unit 1 includes an upper case 10 on which six knobs (operation portions) 2, 3, 4, 5, 6, and 7 are mounted, a lower case 30 that is locked to the upper case 10 by being fitted into the upper case 10 from below, a circuit board 50 that is accommodated between the upper and lower cases 10 and 30, and a connector 70 that is mounted on the lower case 30, as main components.

The knob 2 is an operation portion of a push lock switch (not shown) that locks a glass window, and is mounted in a tubular portion 11, which is formed on an upper portion of the upper case 10, so as to be capable of moving up and down. The knob 2 is linked to the push lock switch fixed to the upper surface of a circuit board 50, and can switch a contact point of the push lock switch.

The knob 3 is an operation portion of a seesaw switch (not shown) that locks a door, and is mounted in a tubular portion 12, which is formed on an upper portion of the upper case 10, so as to be capable of rocking in a front-rear direction. The knob 3 is linked to the seesaw switch fixed to the upper surface of the circuit board 50, and can toggle a contact point of the seesaw switch.

The knob 4 is an operation portion of a seesaw switch (not shown) for a driver's seat that is used to open and close a glass window of a driver's seat, and is mounted in a tubular portion 13, which is formed on the upper portion of the upper case 10, so as to be capable of rocking in the front-rear direction. The knob 4 is linked to the seesaw switch for a driver's seat that is fixed to the upper surface of the circuit board 50, and can toggle a contact point of the seesaw switch.

The knob 5 is an operation portion of a seesaw switch (not shown) for a passenger seat that is used to open and close a glass window of a passenger seat, and is mounted in a tubular portion 14, which is formed on the upper portion of the upper case 10, so as to be capable of rocking in the front-rear direction. The knob 5 is linked to the seesaw switch for a passenger seat that is fixed to the upper surface of the circuit board 50, and can toggle a contact point of the seesaw switch.

The knob 6 is an operation portion of a seesaw switch (not shown) for a rear seat close to the driver's seat that is used to open and close a glass window corresponding to the rear seat close to the driver's seat, and is mounted in a tubular portion 15, which is formed on the upper portion of the upper case 10, so as to be capable of rocking in the front-rear direction. The knob 6 is linked to the seesaw switch for the rear seat close to the driver's seat that is fixed to the upper surface of the circuit board 50, and can toggle a contact point of the seesaw switch.

The knob 7 is an operation portion of a seesaw switch (not shown) for a rear seat close to the passenger seat that is used to open and close a glass window corresponding to the rear seat close to the passenger seat, and is mounted in a tubular portion 16, which is formed on the upper portion of the upper case 10, so as to be capable of rocking in the front-rear direction. The knob 7 is linked to the seesaw switch for the rear seat close to the passenger seat that is fixed to the upper surface of the circuit board 50, and can toggle a contact point of the seesaw switch.

The upper case 10 has the shape of a box, of which the lower portion is opened, having a substantially rectangular parallelepiped shape. The above-mentioned tubular portions 11 to 16 protrude upward from an upper surface 17 of the upper case 10.

The lower case 30 includes a shallow bottom portion 31 that is formed at a rear portion thereof and has a small depth. A connector terminal accommodating portion 32, which is connected to the shallow bottom portion 31, is formed at a portion of the lower case 30, which is closer to the front portion of the lower case than the middle portion of the lower case in the front-rear direction, so as to protrude downward. A box-shaped stepped portion 33, which rises in the form of a step up to the same level as the shallow bottom portion 31, is formed in front of the connector terminal accommodating portion 32.

Flooding preventive cover portions 34 are provided at a substantially middle portion of the lower case 30 in the front-rear direction (in other words, in the rear of the connector terminal accommodating portion 32) on both left and right sides of the connector terminal accommodating portion 32 in a width direction. Front end portions of the flooding preventive cover portions 34 are disposed so as to overlap a rear end portion of the connector terminal accommodating portion 32.

The flooding preventive cover portions 34 are formed in the shape of a flat plate. Lower edges of the flooding preventive cover portions 34 are positioned slightly above a lower edge of the connector terminal accommodating portion 32. Rear end faces 35 of the flooding preventive cover portions 34 are formed of inclined surfaces that are inclined downward toward the front side.

The shallow bottom portion 31, the connector terminal accommodating portion 32, the box-shaped stepped portion 33, and the flooding preventive cover portions 34 are connected integrally with each other at the upper portion of the lower case 30. An upper side wall portion 36, which makes the circuit of the upper portion of the lower case, is formed at the upper portion of the lower case 30.

A pair of left and right engagement accommodating portions 37 are formed at left and right portions of a portion of the upper side wall portion 36 corresponding to the shallow bottom portion 31, and a positioning rib 40 is formed at the middle portion of the front end of the upper side wall portion 36. When the lower case 30 is viewed from below, the engagement accommodating portions 37 are formed at the bottom 39 of the lower case 30 as shown in FIG. 3.

Boss portions 38 into which fixing screws are inserted protrude upward from the upper surface of the rear end portion of the shallow bottom portion 31 and the upper surface of the front end portion of the box-shaped stepped portion 33.

Holes 51 into which the boss portions 38 are inserted are formed in the circuit board 50. The circuit board 50 is formed so that the corresponding boss portions 38 are inserted into the holes 51. The circuit board 50 is placed on the upper side wall portion 36 of the lower case 30.

Figure 3:
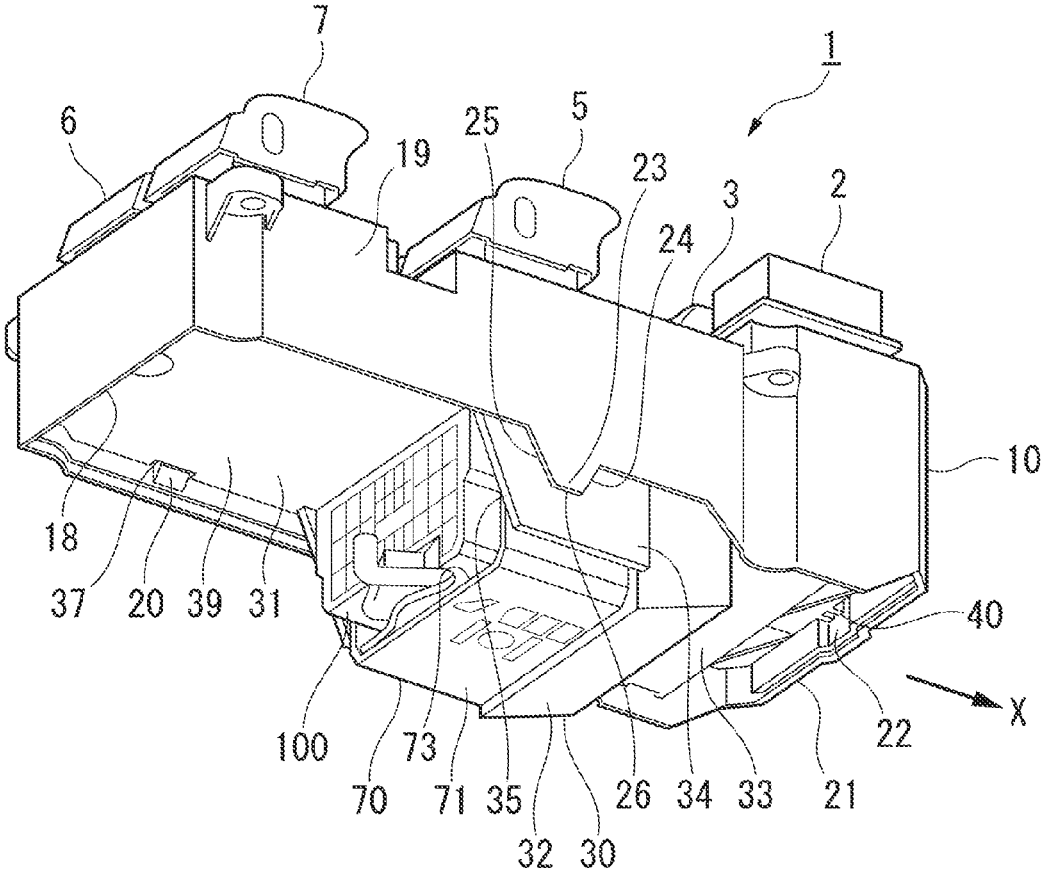
FIG. 3 is a perspective view showing the appearance of the switch unit according to the embodiment on which a plug is mounted, when viewed obliquely from below.
Figure 4:
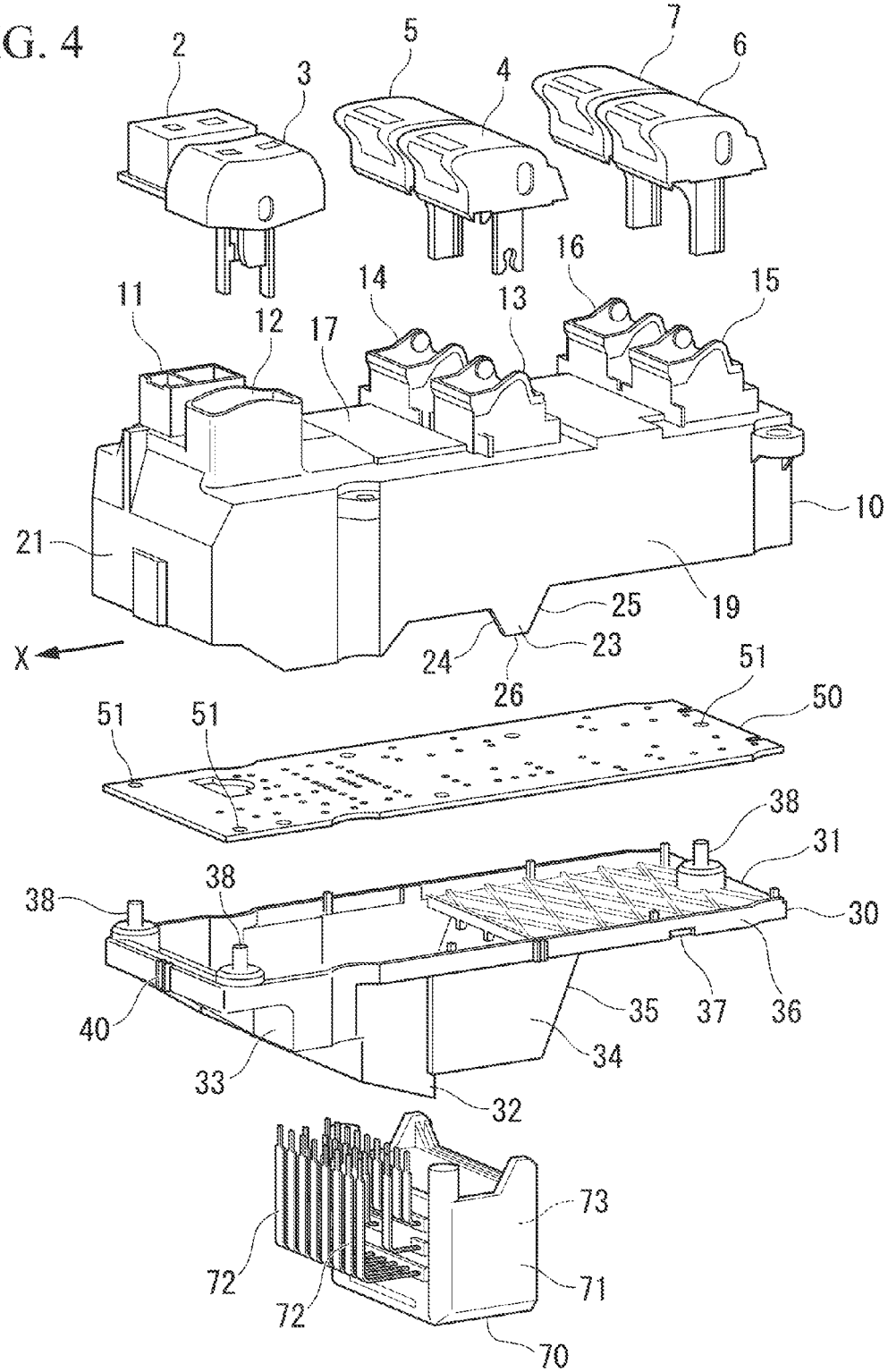
FIG. 4 is an exploded perspective view of the switch unit according to the embodiment.

As shown in FIG. 3, the lower case 30 mounted on the circuit board 50 is inserted into the upper case 10 from an opening 18 that is formed in the lower portion of the upper case 10. At that time, the positioning rib 40 of the lower case 30 is inserted into a positioning recess 22 formed on the inner surface of a front wall portion 21 of the upper case 10, so that the lower case 30 is positioned relative to the upper case 10 in the width direction.

Figure 5:
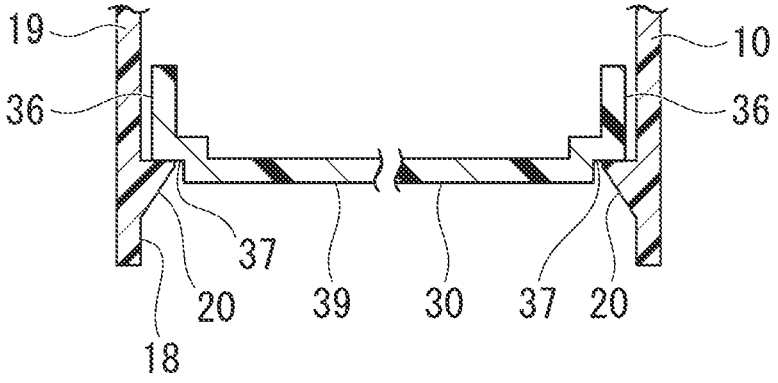
FIG. 5 is a cross-sectional view of main portions of the switch unit according to the embodiment.
Figure 6:
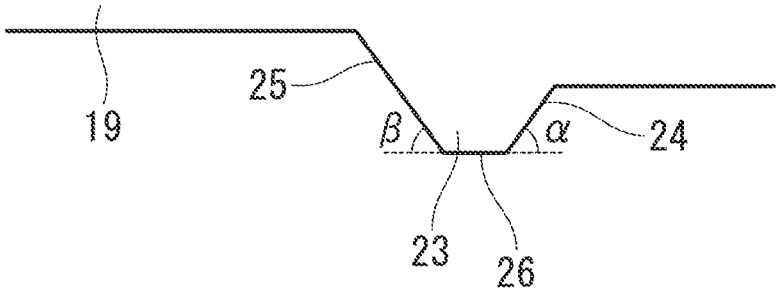
FIG. 6 is an enlarged view of a draining portion of the switch unit according to the embodiment.

As shown in FIGS. 3 and 5, engaging claws 20, which are formed on the inner surfaces of left and right side walls 19 of the upper case 10 extending in the front-rear direction of a vehicle body, are locked to the engagement accommodating portions 37 of the lower case 30. Accordingly, the lower case 30 is temporarily fixed to the upper case 10. The engaging claw 20 is formed in a tapered shape where the length of the engaging claw protruding from the inner surface of the side wall 19 is increased toward the upper side. For this reason, it is possible to easily engage the engaging claws 20 with the engagement accommodating portions 37 by moving the lower case 30 up relative to the upper case 10.

After the lower case 30 is temporarily fixed to the upper case 10 by the engaging claws 20 and the engagement accommodating portion 37, screws (not shown) inserted into the boss portions 38 are screwed to screw holes (not shown) formed in the upper case 10. Accordingly, the lower case 30 is reliably fixed to the upper case 10, and the circuit board 50 is accommodated and fixed between the lower case 30 and the upper case 10. When the lower case 30 is fixed to the upper case 10 as described above, all side surfaces of the upper side wall portion 36 of the lower case 30 are surrounded by the upper case 10.

The connector 70 includes a housing portion 71 and a plurality of terminals 72 that are formed substantially in an L shape and protrude forward from the front end of the housing portion 71. The connector 70 is inserted into the lower case 30 from below and fixed to the lower case 30. When the connector 70 is fixed, the terminals 72 are accommodated in the connector terminal accommodating portion 32 and connected to the circuit board 50. The respective terminals 72 and the terminals of the above-mentioned respective switches fixed to the circuit board 50 are connected to each other through the circuit board 50. That is, the lower case 30 includes the connector 70 at the bottom portion thereof.

The housing portion 71 is disposed between the left and right flooding preventive cover portions 34, and is covered with the flooding preventive cover portions 34 so that only the lower edge portions of the housing portion 71 are exposed to the outside. Further, the rear end of the housing portion 71 and the lower ends of the rear end faces 35 of the flooding preventive cover portions 34 are disposed at substantially the same position in the front-rear direction.

Since the rear portion of the housing portion 71 is opened, a plug 100 can be inserted into the housing portion 71 from an opening portion 73 as shown in FIG. 3. An insertion/separation direction of the plug 100 is a direction that is parallel to the longitudinal direction of the lower case 30 (in other words, the front-rear direction of the vehicle body). The plug 100 is inserted into the connector 70 toward the front side, so that the plug 100 is electrically connected to the terminals 72 of the connector 70.

Draining portions 23, which protrude downward, are formed at the left and right side surfaces of the upper case 10 at a substantially middle portion of the upper case 10 in the front-rear direction. The draining portions 23 are formed integrally with the side walls 19 in the shape of a flat plate. In this embodiment, the draining portions 23 are formed in a trapezoidal shape so that the width of the draining portion in the longitudinal direction of the upper case 10 (in other words, the width of the draining portion in the front-rear direction of the vehicle body) is reduced toward the bottom. The draining portions 23 are positioned outside the flooding preventive cover portions 34 of the lower case 30 as shown in FIG. 3, and are positioned in front of the opening portion 73 of the connector 70 as shown in FIG. 1. In other words, the draining portions 23 are disposed behind the position, which overlaps the opening portion 73 of the connector 70, in the insertion direction of the plug 100.

An inclined side 24 formed at the front portion of the draining portion 23 is formed so that an inclination angle a between the inclined side 24 and a horizontal direction is in the range of, preferably, 45° to 70° and, more preferably, 55° to 65°. Meanwhile, an inclined side 25 formed at the rear portion of the draining portion is formed so that an inclination angle β between the inclined side 25 and the horizontal direction is in the range of, preferably, 45° to 70° and, more preferably, 55° to 65°. Further, the inclination angle α between the inclined side 24 and the horizontal direction and the inclination angle β between the inclined side 25 and the horizontal direction have been formed so as to be equal to each other in this embodiment, but the invention is not limited thereto. Furthermore, the length of the inclined side 25, which is disposed close to the rear portion of the vehicle body, is larger than the length of the inclined side 24, which is disposed close to the front portion of the vehicle body. In other words, the length of the inclined side 25, which is disposed on the near side in the insertion direction of the plug 100, is larger than the length of the inclined side 24 that is disposed on the far side in the insertion direction of the plug 100. Moreover, it is preferable that the lower end of the inclined side 25 formed close to the rear portion of the vehicle body be positioned closer to the front portion of the vehicle body than the opening portion 73 of the connector 70.

Next, the operation of the switch unit 1 will be described with reference to FIGS. 7 to 9. Meanwhile, a dashed-dotted line shows the line of flow of water in FIGS. 7 to 9.

Figure 7:
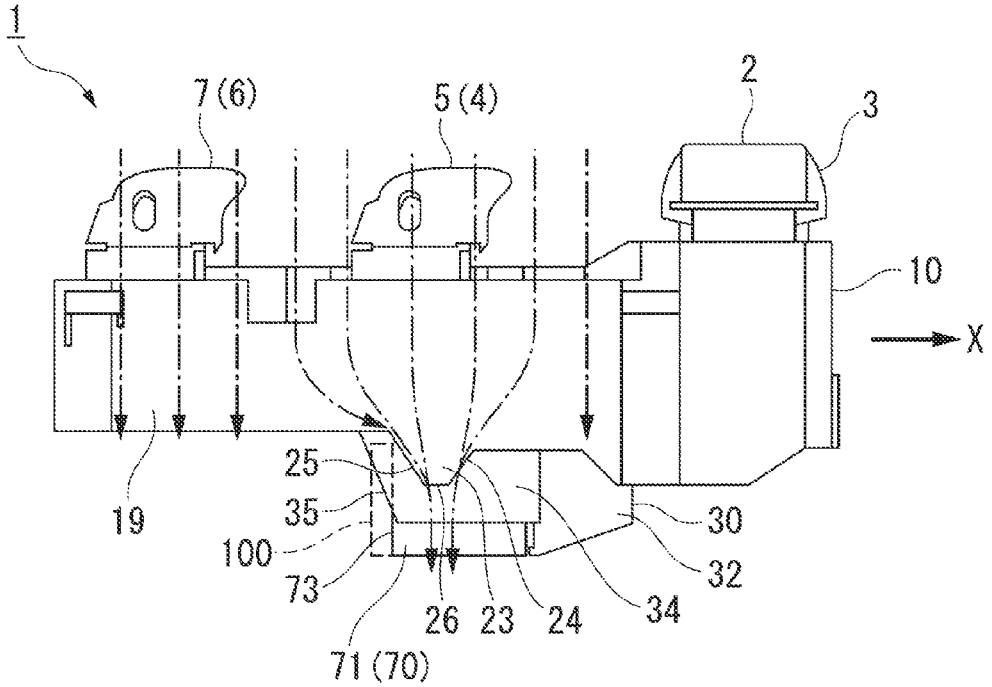
FIG. 7 is a view illustrating a drain state when the switch unit according to the embodiment is in a horizontal attitude.
Figure 8:
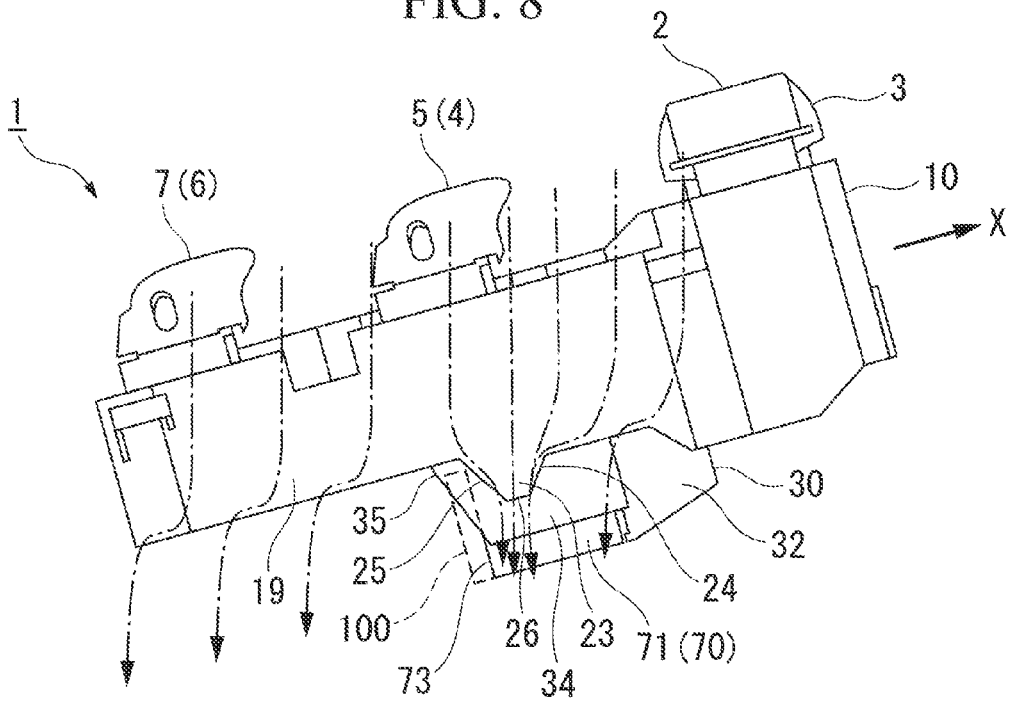
FIG. 8 is a view illustrating a drain state when the switch unit according to the embodiment is in an inclined attitude where the rear portion of the switch unit is lowered.
Figure 9:
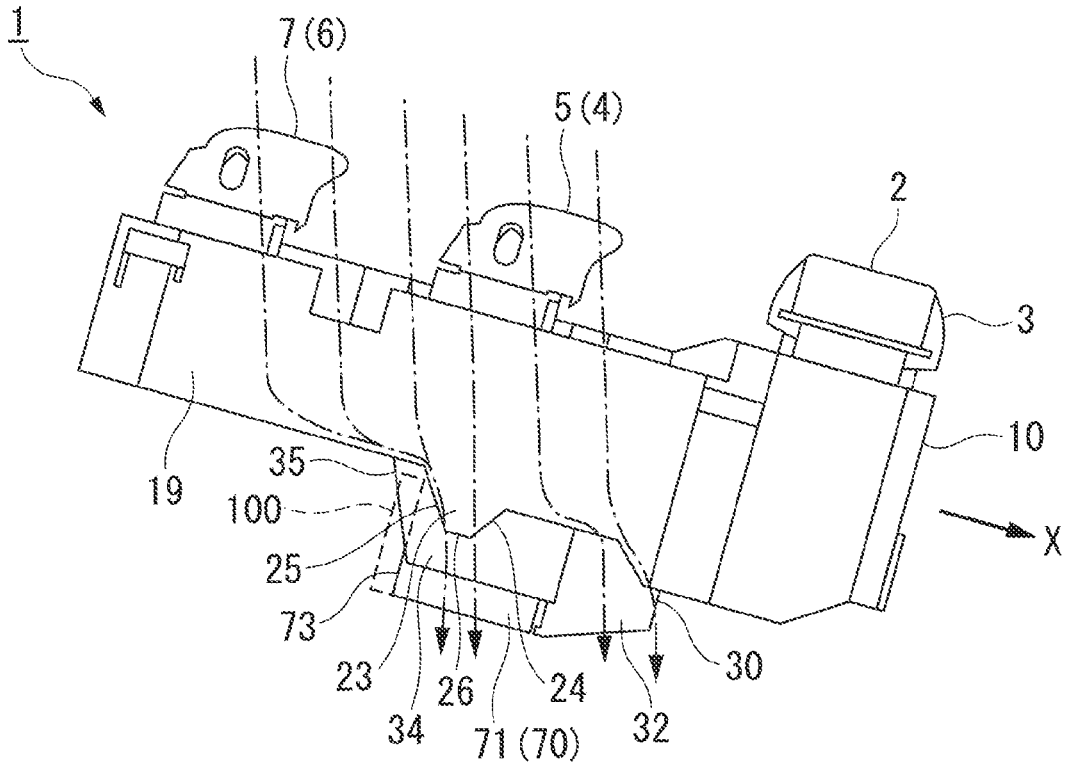
FIG. 9 is a view illustrating a drain state when the switch unit according to the embodiment is in an inclined attitude where the front portion of the switch unit is lowered.

For example, it is supposed that rain falls on the switch unit 1 when a door corresponding to the driver's seat is opened while it is raining FIG. 7 shows a case when a vehicle stops or travels in a horizontal place, FIG. 8 shows a case when a vehicle stops or travels on an uphill road, and FIG. 9 shows a case when a vehicle stops or travels on a downhill road.

Even in any one of cases, rain falling on the switch unit 1 trickles down the side walls 19 of the upper case 10 and falls down. Further, when water droplets, which fall down from immediately above the draining portions 23, reach both the inclined sides 24 and 25 of the draining portions 23, the water droplets flow down along these inclined sides 24 and 25. Finally, the water droplets are collected at lower sides 26 of the draining portions 21, and are separated and fall down from the lower sides 26.

Water droplets, which do not trickle down portions of the side walls 19 of the upper case 10 immediately above the draining portions 23 but trickle down the peripheral portions of the draining portions 23, are also drawn into the flow of water flowing to both the inclined sides 24 and 25 of the draining portions 23, are guided to the draining portions 23, and flow down along the inclined sides 24 and 25. Finally, the water droplets are collected at lower sides 26 of the draining portions 21, and are separated and fall down from the lower sides 26.

Since it is possible to guide water, which flows around the draining portions 23, to the draining portions 23 and to collect the flow of water at the lower sides 26 of the draining portions 23 as described above, it is possible to specify drain positions at the lower sides 26 of the draining portions 23. Since the positions of the lower sides 26 of the draining portions 23 are shifted to the front portion of the vehicle body from the position of the opening portion 73 of the connector 70, the opening portion 73 of the connector 70 is not flooded with water falling down from the lower sides 26. That is, when the draining portions 23 are formed, it is possible to actively guide water, which might fall down from the side walls 19 of the upper case 10 near the opening portion 73 of the connector 70 when the draining portions 23 are not formed, to the draining portions 23. Accordingly, it is possible to prevent the opening portion 73 of the connector 70 from being flooded. As a result, it is possible to reduce the probability that water permeates into the connector 70 from the opening portion 73 of the connector 70.

Further, even when a large amount of water falls, it is possible to guide a large amount of water by making the large amount of water trickle down the inclined sides 24 and 25 of the draining portions 23.

The long inclined side 25 of the flow passage for water can guide water over a long distance as compared to the short inclined side 24 of the flow passage for water. Accordingly, the force of water flowing along the long inclined side 25 of the flow passage for water becomes stronger than the force of water flowing along the short inclined side 24 of the flow passage for water. That is, a force, which guides water, of the long inclined side 25 of the flow passage for water becomes stronger than that of the short inclined side 24 of the flow passage for water. For this reason, even when the switch unit 1 is in an inclined attitude where the rear portion of the switch unit in the longitudinal direction is lowered as shown in FIG. 8, it is possible to reduce the probability that water adheres near the opening portion 73 of the connector 70.

In addition, since holes or the like used to lock the lower case 30 are not formed on the side walls 19 of the upper case 10, it is possible to significantly reduce the probability that water permeates into the upper and lower cases 10 and 30.

[Other Embodiments]

Meanwhile, the invention is not limited to the above-mentioned embodiment.

For example, in the above-mentioned embodiment, the inclined sides 24 and 25 of the draining portions 23 have been formed in a linear shape. However, the inclined sides may be formed in a concave curved shape. Further, the shape of the draining portion 23 is not limited to a trapezoidal shape, and may be, for example, an inverted triangular shape. In this case, inclined sides may also be formed in a linear shape or a concave curved shape.

Furthermore, the switch unit is not limited to a power window switch and may be applied as switch units for a variety of uses.

INDUSTRIAL APPLICABILITY

According to the invention, water having trickled down the side surfaces of the upper case is guided to the draining portions and flows down so that the width is gradually reduced in accordance with the shape of the draining portion. Accordingly, it is possible to control a drain position. Further, even when a large amount of water falls, it is possible to guide the large amount of water by making the large amount of water trickle down.

REFERENCE SIGNS LIST

1: switch unit
2 to 7: knob (operation portion)
10: upper case 10
19: side wall
20: engaging claw
23: draining portion
24, 25: inclined side
30: lower case
37: engagement accommodating portion
39: bottom
50: circuit board
70: connector
72: terminal
73: opening portion
100: plug

The invention claimed is:

1. A switch unit comprising:

an upper case on which operation portions are mounted;

a circuit board on which switches are mounted, contact points of said switches being switched through operation of the operation portions;

a lower case that is fitted to the upper case so that side surfaces of the lower case are surrounded by the upper case, the circuit board being accommodated between the upper case and the lower case; and a connector provided on a bottom portion of the lower case and including terminals electrically connected to the switches, wherein draining portions, which are formed integrally with side walls forming side surfaces of the upper case so as to protrude downward and have two inclined sides at front and rear sides in a direction along a longitudinal direction of the upper case so that the width of the draining portion is gradually reduced toward the lower side from the upper side, are formed at the side surfaces of the upper case, wherein the connector includes an opening portion that allows a plug, which is electrically connected to the connector, to be electrically connected to the terminals in a direction parallel to a longitudinal direction of the lower case as an insertion/separation direction, and wherein each of said two inclined sides are inclined with respect to a horizontal direction at substantially a same angle, said inclined sides being disposed on a near side in the insertion direction of the plug and on a far side in the insertion direction of the plug, respectively, and the inclined side, which is disposed on the near side in the insertion direction of the plug, is longer than the inclined side that is disposed on the far side in the insertion direction of the plug.

2. The switch unit according to claim 1, wherein the draining portion is formed into a plate shape having said two inclined sides.

3. The switch unit according to claim 2, wherein engaging claws, which are engaged with the lower case, are formed on insides of the side surfaces of the upper case, engagement accommodating portions, which are engaged with the engaging claws of the upper case, are formed at a bottom of the lower case, and the bottom of the lower case is fitted into the upper case and the engaging claws are locked to the engagement accommodating portions.

4. The switch unit according to claim 1, wherein the draining portions are disposed behind a position, which overlaps the opening portion of the connector in the longitudinal direction of the lower case, in an insertion direction of the plug.

5. The switch unit according to claim 4, wherein engaging claws, which are engaged with the lower case, are formed on insides of the side surfaces of the upper case, engagement accommodating portions, which are engaged with the engaging claws of the upper case, are formed at a bottom of the lower case, and the bottom of the lower case is fitted into the upper case and the engaging claws are locked to the engagement accommodating portions.

6. The switch unit according to claim 1, wherein engaging claws, which are engaged with the lower case, are formed on insides of the side surfaces of the upper case, engagement accommodating portions, which are engaged with the engaging claws of the upper case, are formed at a bottom of the lower case, and the bottom of the lower case is fitted into the upper case and the engaging claws are locked to the engagement accommodating portions.

7. The switch unit according to claim 1, wherein the draining portions are provided at a substantially middle portion of the upper case in a front-rear direction.

* * * * *